US009665046B2

(12) United States Patent
Aoto et al.

(10) Patent No.: US 9,665,046 B2
(45) Date of Patent: May 30, 2017

(54) BELT DRIVING ROLLER INCLUDING ELECTROVISCOUS FORCE DEVELOPING MEMBER, AND BELT DRIVING DEVICE USING SAME

(71) Applicants: Jun Aoto, Kanagawa (JP); Masaki Yoshino, Kanagawa (JP); Tomoko Kino, Kanagawa (JP); Tojiro Aoyama, Kanagawa (JP); Yuta Shimizu, Kanagawa (JP)

(72) Inventors: Jun Aoto, Kanagawa (JP); Masaki Yoshino, Kanagawa (JP); Tomoko Kino, Kanagawa (JP); Tojiro Aoyama, Kanagawa (JP); Yuta Shimizu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 113 days.

(21) Appl. No.: 14/828,732

(22) Filed: Aug. 18, 2015

(65) Prior Publication Data

US 2016/0061300 A1 Mar. 3, 2016

(30) Foreign Application Priority Data

Aug. 27, 2014 (JP) ..... 2014-172427

(51) Int. Cl.

*G03G 15/20* (2006.01)
*G03G 15/16* (2006.01)
*G03G 15/08* (2006.01)

(52) U.S. Cl.

CPC ..... *G03G 15/2017* (2013.01); *G03G 15/1615* (2013.01); *G03G 15/0806* (2013.01);
(Continued)

(58) Field of Classification Search

CPC ..... G03G 15/162; G03G 15/2057; G03G 15/2017; G03G 15/1615; G03G 15/0806;
(Continued)

(56) References Cited

U.S. PATENT DOCUMENTS 4,444,864 A * 4/1984 Takahashi ..... G03G 15/065 399/314
4,684,481 A * 8/1987 Jackson ..... H01B 1/24 252/510

(Continued)

FOREIGN PATENT DOCUMENTS

JP 2000-147950 5/2000
JP 2000-198568 7/2000

(Continued)

OTHER PUBLICATIONS

"Occurrence mechanism of shear stress in ER gel" (Collection of Papers by Japan Fluid Power System Society, vol. 36/No. 1, pp. 15-21 (Jan. 2005)).

*Primary Examiner* — Jason L Vaughan
(74) *Attorney, Agent, or Firm* — Cooper & Dunham LLP

(57) ABSTRACT

Provided is a belt driving roller for a belt driving device configured to drive and rotate an endless belt with at least one driving roller of a plurality of rollers over which the belt is hung by its internal surface, wherein the belt driving roller includes an electroviscosity retaining member of which surface viscosity force reversibly changes under an effect of an electric field.

7 Claims, 3 Drawing Sheets

(52) U.S. Cl.
CPC ..... *G03G 2215/00156* (2013.01); *G03G 2215/1623* (2013.01); *G03G 2215/2032* (2013.01)

(58) Field of Classification Search
CPC ... G03G 2215/1623; G03G 2215/2032; G03G 2215/00156; B65H 2519/00
USPC ..... 492/30, 56, 58
See application file for complete search history.

(56) References Cited

U.S. PATENT DOCUMENTS 5,290,821 A * 3/1994 Sakurai ..... C08K 3/04 521/82
5,409,435 A * 4/1995 Daniels ..... A63B 21/00845 482/5
5,486,560 A * 1/1996 Shiga ..... C08K 3/02 252/500
5,607,996 A 3/1997 Nichols et al.
6,119,498 A * 9/2000 Knudson ..... B21D 5/08 72/177
6,257,133 B1 * 7/2001 Anderson ..... D21F 3/06 100/155 R
6,681,905 B2 * 1/2004 Edmondson ..... B60G 13/001 188/130
7,387,584 B2 * 6/2008 Miyata ..... F16H 7/12 474/197
7,459,203 B2 * 12/2008 Pickering ..... G03G 15/2057 399/333
7,543,686 B2 * 6/2009 Kulak ..... B66B 7/044 187/292
7,665,715 B2 * 2/2010 Peeters ..... F16K 13/10 251/129.01
7,673,562 B2 * 3/2010 Pattekar ..... B41C 1/00 101/395
8,173,229 B2 5/2012 Aoto
8,934,821 B2 1/2015 Kubo et al.
9,193,565 B2 * 11/2015 Piech ..... B66B 7/048
2006/0249705 A1 * 11/2006 Wang ..... A61L 29/18 252/62.51 C
2011/0177238 A1 7/2011 Aoto et al.
2011/0293824 A1 12/2011 Aoto et al.
2013/0319859 A1 * 12/2013 Wong ..... B60C 1/00 204/450
2014/0079445 A1 3/2014 Katoh et al.
2014/0248069 A1 9/2014 Kubo et al.
2014/0248070 A1 9/2014 Kubo et al.

FOREIGN PATENT DOCUMENTS

JP 2000-272772 10/2000
JP 2005-255701 9/2005
JP 2011-046785 3/2011
JP 2012-042907 3/2012
JP 2013203749 A * 7/2013 ..... C09J 7/00
SU 1017508 A * 6/1981 ..... B30B 5/04

* cited by examiner

BELT DRIVING ROLLER INCLUDING ELECTROVISCOUS FORCE DEVELOPING MEMBER, AND BELT DRIVING DEVICE USING SAME

BACKGROUND OF THE INVENTION

Field of the Invention

The present invention relates to a belt driving roller including an electroviscous force developing member, and a belt driving device using the same.

Description of the Related Art

Generally, belt driving devices for driving and rotating an endless belt are configured to rotate the belt by rotating driving rollers by means of a tensile force between the driving rollers and a frictional force that are caused because the belt is tensed by the plurality of rollers over which the belt is hung by its internal surface (back surface).

According to this method, a belt skew, which is a shift of the belt toward an edge during its continuous rotation, occurs due to tensile force variations in the direction of the width of the belt. Hence, it is necessary to correct the belt skew by providing such a mechanism as described in Japanese Patent Application Laid-Open (JP-A) Nos. 2000-272772, 2000-198568, and 2000-147950. However, correction by means of swaying of a driven roller as described in JP-A No. 2000-198568 will be ineffective due to wear of the surface of this roller due to continuous use. Restriction of the belt skew by means of a guide member provided on the edge of the belt as described in JP-A No. 2000-147950 may cause the belt to be torn because a stress concentrates on a portion of the belt on which the guide member abuts.

Meanwhile, an electro-rheological gel (ER gel) that reversibly develops viscosity under an electric field has been reported ("Occurrence mechanism of shear stress in ER gel" (Collection of Papers by Japan Fluid Power System Society, vol. 36/no. 1, pp. 15-21 (January 2005))). According to this document, electro-rheological particles (ER particles) are dispersed in a silicone gel and exposed at the surface of the gel. It has been discovered that when an electric field is applied, the ER particles in the gel are attracted to each other, and the ER particles exposed at the surface are drawn into the gel, which upthrusts the gel and reversibly changes the surface condition. It is inferred that a relatively weak adhesive force on the surface due to a surface condition produced by the ER particles under no electric field changes to a greater adhesive force under an electric field due to the effect of the gel.

JP-A Nos. 2005-255701 and 2011-46785 describe use of an electro-rheological fluid in a power transmission device and a control device such as a clutch, a damper, a shock absorber, and a torque converter. U.S. Pat. No. 5,607,996 describes use of an electro-rheological elastomer composition that changes its Young's modulus by at least 2 Mpa upon application of an electric field in a transmission structure and a chassis structure of an automobile. The techniques of JP-A Nos. 2005-255701 and 2011-46785 intend to enhance the durability of the power transmission device and the control device such as the clutch, the damper, the shock absorber, and the torque converter in which the electro-rheological gel is used, by using a specific type of particles as the electro-rheological particles. The technique described in U.S. Pat. No. 5,607,996 relates to the electro-rheological elastomer composition obtained by dispersing the electro-rheological particles made of a polymerizable material in an elastomer material crude rubber, but does not relate to a belt.

Further, the present inventors have already proposed a powder transfer device including: a powder bearer, e.g., an image bearer; and a surface moving member movable synchronously with a surface moving speed of the powder bearer and having a surface capable of receiving a powder (e.g., a residual toner) from the surface of the powder bearer, wherein the surface moving member includes an electroviscous gel layer in which the electro-rheological particles that reversibly develop a viscosity force under an electric field are dispersed (JP-A No. 2012-42907).

As described above, the conventional technique described above drives the belt by imposing a tensile force between the plurality of rollers, which causes the belt skew and necessitates an additional mechanism for correcting the belt skew, which leads to a complicated device mechanism and durability limitation depending on the life span of the mechanism. The belt itself has also been required to have an enough strength and durability to endure a large tensile load constantly imposed thereon.

SUMMARY OF THE INVENTION

An object of the present invention is to provide a belt driving device including driving rollers capable of driving and rotating a belt without imposing a load on the belt, and realizing stable driving causing no belt skew without an additional mechanism for controlling meandering of the belt.

As the result of earnest studies, the present inventors have found that the belt skew that occurs during continuous driving of the belt by endless belt driving rollers can be overcome with an electroviscous member that develops a viscosity force upon application of an electric field. That is, the present inventors have used the electroviscous member as the belt driving rollers, which made it possible to make the belt driving rollers adsorb the belt by applying an electric field to the belt driving rollers, and to drive the belt with this adsorbing force instead of a strong tensile force between the belt driving rollers, leading to a finding that the belt can be driven continuously without the belt skew.

In this way, the present invention solves the problem of the belt skew with a novel and excellent improvement of the belt driving rollers, which are the other party relative to the belt member (or a belt-type member), in contrast with the technique described in JP-A No. 2005-255701 that uses a member constituted by the electroviscous member as the belt member (or a belt-type member).

That is, the problem described above is solved by the following configuration (1) of the present invention.

(1) "A belt driving roller for a belt driving device configured to drive and rotate an endless belt with at least one driving roller of a plurality of rollers over which the belt is hung by its internal surface, the belt driving roller including:

an electroviscosity retaining member of which surface viscosity force reversibly changes under an effect of an electric field."

DETAILED DESCRIPTION OF THE INVENTION

Figure 1:
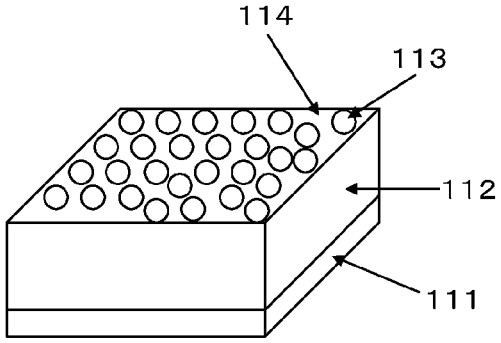
FIG. 1 is a diagram showing an example configuration of a member of the present invention.

The present invention will be described in detail below.

The present invention relates to a "belt driving roller" having the configuration described in (1) above. However, as will be understood from the following detailed description, this "belt driving roller" encompasses a "belt driving roller" having the aspects described in (2) and (3) below, a "belt driving roller" having the aspects described in (4) to (9) below, and an "electrophotography apparatus" having the aspect described in (10) below. Hence, these will be described in detail together.

(2) "The belt driving roller according to (1), wherein the electroviscosity retaining member includes at least one layer over a conductive base member, and an outermost layer of the electroviscosity retaining member is an elastic layer holding particles at a surface thereof in a manner to partially expose the particles and having a surface layer structure composed of protruding regions formed of exposed portions of the particles and elastic body-exposed regions in which the particles having the exposed portions are absent."

(3) "The belt driving roller according to (2), wherein the conductive base member includes a comb-teeth-shaped conductive region over an insulating base member, the comb-teeth-shaped conductive region being composed of conductive portions for positive bias application and conductive portions for negative bias application that are arranged alternately."

(4) "A belt driving device configured to drive and rotate an endless belt with at least one driving roller of a plurality of rollers over which the belt is hung by its internal surface, wherein the driving roller includes an electroviscosity retaining member of which surface viscosity force reversibly changes under an effect of an electric field."

(5) "The belt driving device according to (4), wherein the belt is driven to rotate only when an electric field is applied to the driving roller, and is not driven to rotate when no electric field is applied to the driving roller."

(6) "The belt driving device according to (4), wherein the electroviscosity retaining member includes at least one layer over a conductive base member, and an outermost layer of the electroviscosity retaining member is an elastic layer holding particles at a surface thereof in a manner to partially expose the particles and having a surface layer structure composed of protruding regions formed of exposed portions of the particles and elastic body-exposed regions in which the particles having the exposed portions are absent."

(7) "The belt driving device according to (6), wherein the conductive base member includes a comb-teeth-shaped conductive region over an insulating base member, the comb-teeth-shaped conductive region being composed of conductive portions for positive bias application and conductive portions for negative bias application that are arranged alternately."

(8) "The belt driving device according to (5), wherein the electroviscosity retaining member includes at least one layer over a conductive base member, and an outermost layer of the electroviscosity retaining member is an elastic layer holding particles at a surface thereof in a manner to partially expose the particles and having a surface layer structure composed of protruding regions formed of exposed portions of the particles and elastic body-exposed regions in which the particles having the exposed portions are absent."

(9) "The belt driving device according to (8), wherein the conductive base member includes a comb-teeth-shaped conductive region over an insulating base member, the comb-teeth-shaped conductive region being composed of conductive portions for positive bias application and conductive portions for negative bias application."

(10) "An electrophotography apparatus, including:

the belt driving device according to (5)."

Exertion of the functionality of the present invention will be described with reference to FIG. 1 to FIG. 3. What is to be described is an example, and the present invention is not limited to this example.

The member in this example includes a base member layer 111 and an elastic layer 112. The surface of the elastic layer 112 has a configuration in which regions of particles 113 and elastic body-exposed regions 114 are present in a mingling state, with the particles 113 buried in the elastic layer 112 in a manner to be partially exposed.

Figure 2:
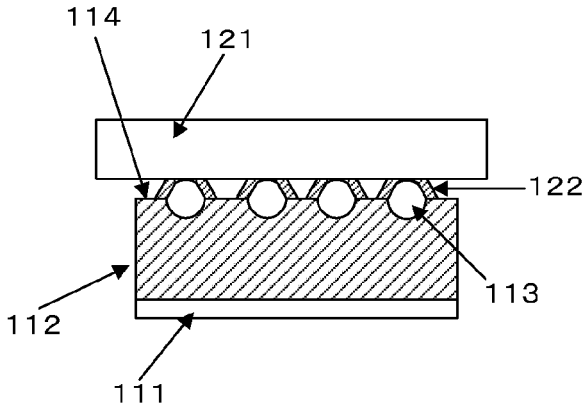
FIG. 2 is a diagram showing a state that an abutting object contacts the surface of a member of the present invention and an electric field is applied to the member.

FIG. 2 shows a state that an abutting object 121 contacts the surface of the member, and an electric field is applied to the member. When an electric field is applied to the member, there occurs a phenomenon that the elastic body-exposed regions 114 of the elastic layer having an adequate conductivity change shape and upthrust (122) from the circumference of the particles to thereby contact the abutting object 121, due also to that the particles 113 partially exposed at the surface of the elastic layer are electrostatically attracted to the particles 113 completely buried in the elastic layer 112 under the effect of the electric field. Because the elastic layer is a material having a higher viscosity than that of the particles, its adhesiveness with the abutting object changes upon application of the electric field. Specifically, its viscosity force and friction coefficient increase. Hence, it is possible to control presence or absence of adhesiveness and a torque between the members by applying the electric field.

Next, the configuration of the member will be described.

Figure 3:
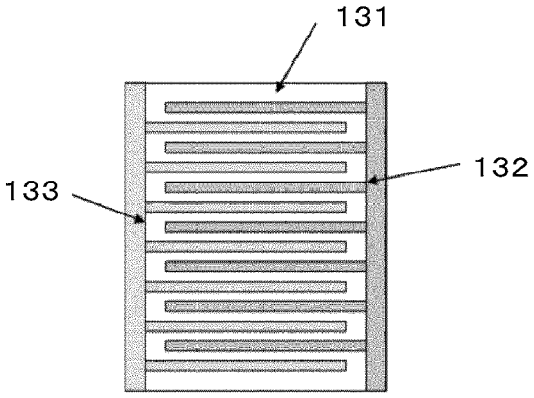
FIG. 3 is another diagram showing an example configuration of a member of the present invention.

The base member layer 111 may have a configuration as shown in FIG. 3.

FIG. 3 shows a configuration in which a comb-teeth-shaped electrode region composed of positive electrodes 132 and negative electrodes 133 that are arranged alternately is provided over a base material 131 made of an insulating material, and the electric field is to be applied across the electrodes. The phenomenon of FIG. 2 can occur under the electric field that appears across the electrodes with this configuration. Although positive electrodes and negative electrodes are mentioned, what is meant is not that a positive bias and a negative bias must necessarily be applied to both of the electrodes respectively, but that either one of them may be earthed.

Examples of the method for forming a comb-teeth-shaped structure includes a method of processing an insulating substrate or polyimide film or the like of which surface is plated with copper into a designed electrode shape, and a method of forming a conductive ink in which metal particles are dispersed into the shape by inkjet printing.

The conditions for forming the structure, such as the width of the electrodes, the distance between the electrodes, etc. may be set appropriately such that the effect of the electric field can be obtained sufficiently and no abnormal electrical discharge may occur across the electrodes.

The electric field to be applied across the electrodes may be a direct-current field, an alternating-current field, or a direct-current field on which an alternating-current field is superimposed.

The elastic layer 112 is made of a flexible material in order to exert the function of the present invention sufficiently.

The material may be a thermoplastic or thermosetting elastomer, gel, rubber, etc.

Examples thereof include silicone-based, fluorine-based, urethane-based, polyamide-based, and acrylic-based elastomers and gels, and silicone-based, fluorine-based, urethane-based, acrylic-based, nitrile-based, and butadiene-based synthetic rubbers.

A preferable material is appropriately selected from these.

Hence, it is preferable to select a material having some degree of conductivity. Examples of such materials include a urethane rubber, an epichlorohydrin rubber, a nitrile rubber, and an acrylic rubber.

A conductive material may be added to adjust a resistance value. Examples of the conductive material include a metal oxide, carbon black, an ionic conductive agent, and a conductive polymeric material.

Examples of the metal oxide include zinc oxide, tin oxide, titanium oxide, zirconium oxide, aluminium oxide, and silicon oxide. Examples thereof may also include those metal oxides described above that have been previously subjected to a surface treatment to have a better dispersibility.

Examples of the carbon black include Ketjen black, furnace black, acetylene black, thermal black, and gas black.

Examples of the ionic conductive agent include a tetraalkyl ammonium salt, a trialkyl benzyl ammonium salt, an alkyl sulfonate salt, an alkyl benzene sulfonate salt, alkyl sulfate, a glycerin fatty acid ester, a sorbitan fatty acid ester, polyoxyethylene alkyl amine, a polyoxyethylene fatty alcohol ester, alkyl betaine, and lithium perchlorate. These may be used in combination.

The electric resistance adjusting material of the present invention is not limited to the compounds described above. In the present invention, adjustment by an ionic conductive agent is particularly preferable because an ionic conductive agent has a high uniformity, can suppress dependency of a resistance value on an applied bias low, and hardly allows a leakage due to an electric field.

Additives such as a processing aid, a flame retardant, a stiffener, etc. may also be added according to necessity.

The elastic layer member is a member to which a high electric field is to be applied. Therefore, it is preferably flame-retardant in view of safety. A preferable flame retardancy is V-1 or greater when the thickness of the elastic layer is greater than 250 μm, and VTM-1 or greater when the thickness is 250 μm or less.

In the present invention, a sufficient flexibility is required in order to develop a sufficient electroviscous effect. In the phenomenon of the ER particles described in the Related Art section, the effect is developed based on shape change of the gel due to dynamic behaviors of the ER particles under the effect of the electric field. Unlike this, the present invention is based on a phenomenon that the elastic layer itself is displaced under the effect of the electric field. Therefore, an electric characteristic and flexibility of the elastic layer are critical. The indicator to represent the electric characteristic may be a resistance value, and the indicator to represent the flexibility may be a Martens hardness.

The elastic layer needs to have viscosity and tack in addition to the flexibility. A necessary material is selected appropriately depending on a necessary viscosity force required during an effect of an electric field.

The resistance value of the member as the finished product is preferably from 7 (Log(Ω·m)) to 12 (Log(Ω·m)) when expressed in common logarithm of a volume resistance thereof when 100 V is applied, and preferably from 10 (Log(Ω/_)) to 14 (Log(Ω/_)) when expressed in common logarithm of a surface resistance thereof when 100 V is applied. When the volume resistance value is excessively high, the member cannot develop the electroviscous effect sufficiently, or an electric field needs to have an extremely high strength to be effective, which is unfavorable. When the volume resistance value is excessively low, an excessively high current will flow across the electrodes, and the elastic layer will not develop an ER phenomenon.

As the flexibility, a Martens hardness measured by an ultra-microhardness tester is preferably 0.4 $N/mm^2$ or lower. Above this level, a sufficient electroviscous effect cannot be developed.

The resistance values are set in the ranges described above in order to make the electric field be effective sufficiently. However, the effect of the electric field is also dependent on a film thickness of the elastic layer. The film thickness is preferably from 5 μm to 500 μm. A film thickness less than 5 μm is unfavorable because an abnormal electrical discharge is likely to occur due to a defect in the coated film. A film thickness greater than 500 μm is unfavorable because the electric field is less effective, which makes it necessary to apply a high voltage, which makes it likely for an abnormal electrical discharge to be induced.

The elastic layer 112 has the particles 113 buried therein in a manner to be partially exposed at the surface thereof.

Hence, in the normal state, the contact points on the surface that are to contact another object to contact the surface are only the particles, and the elastic layer does not contact the object.

It is preferable that the particles be arranged at the surface of the elastic layer uniformly. Hence, it is preferable that the particles be spherical and uniform in the particle diameter. Further, it is preferable that the particles be made of a material that makes it difficult for the particles to aggregate with each other, because a uniform structure can be formed easily.

Examples of such a material include organic particles such as silicone particles and acrylic particles, and inorganic particles such as silica, titanium oxide, aluminium oxide, and zinc oxide.

The ratio by which the particles 113 are buried in the elastic layer 112 is preferably from 40% to 70%.

A ratio less than 40% is unfavorable because the particles will be detached easily.

The particles can be used as long as the particles have a size of from 1 μm to 100 μm, but a preferable size thereof is from 4 μm to 20 μm. An excessively small size of the particles is unfavorable because the elastic layer will directly contact another object even in the normal state. An excessively large size of the particles is unfavorable because the performance of the functionality exertion upon application of an electric field will be low.

A rate of an in-plane occupation area of the particles over the surface of the elastic layer is preferably from 50% to 70%.

When it is less than 50%, the elastic layer is exposed extremely broadly, and the elastic layer is influential even in the normal state.

On the other hand, when it is greater than 70%, the elastic layer is exposed extremely narrowly, and the functionality exertion upon application of an electric field will be low, which is unfavorable.

Next, a method for producing the above configuration as a belt driving roller will be described. The method described below is a non-limiting example.

A base material as a cored bar of the roller may be a metallic cored bar, or a plastic cored bar.

The driving roller may be produced by directly forming the above-described electrode structure on a roller, or by winding a film over which the above-described electrode structure is formed around the roller.

The present invention will be described based on the method using a film over which an electrode is formed.

The film as a base material over which the electrode is formed may be a common insulating resin film. A suitable example thereof is a polyimide film over which a copper foil is stacked.

The copper foil etched into an electrode pattern as shown in FIG. 3 may be used.

Figure 6:
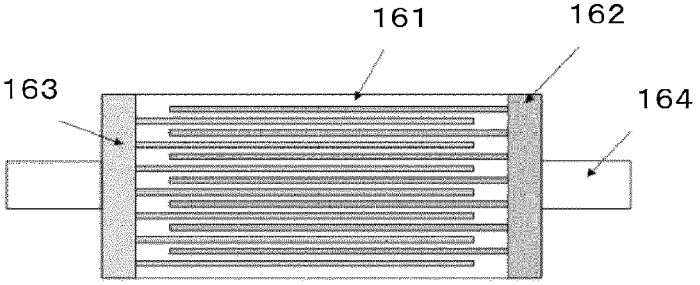
FIG. 6 is a diagram showing an example in which a polyimide film obtained by forming an electrode on a member of the present invention is wound around a roller and bonded to the roller with an adhesive.

The polyimide film over which the electrode is formed is wound around the roller, bonded to the roller with an adhesive, and produced as the roller as shown in FIG. 6. In FIG. 6, the reference numeral 161 denotes the insulating film, and the reference numeral 164 denotes the cored bar of the roller.

Next, the elastic layer is stacked.

Here, it is preferable that terminal electrode portions 162 and 163 functioning as power feeding portions for applying the electric field to the electrode be covered by masking or the like such that the elastic layer may not be stacked over the portions.

It is possible to form the elastic layer over the base member layer by injection molding, extrusion molding, or the like. However, in the present invention, it is effective to form the elastic layer by applying a coating liquid.

For example, a liquid elastomer, a liquid rubber, or the like may be used in the coating liquid, or a solution obtained by dissolving a solvent-soluble resin, elastomer, or rubber material in a solvent may be used as the coating liquid.

Here, a method of applying and forming a coating over the base member layer with a thermosetting liquid elastomer material will be described. As in the case of the base member layer, with a liquid supplying device such as a nozzle and a dispenser, a coating liquid containing at least a liquid thermosetting elastomer material is applied and cast (to form a coating film) over a cylindrical metal mold uniformly over the entire external surface of the cylindrical mold while the mold is rotated slowly.

Figure 4:
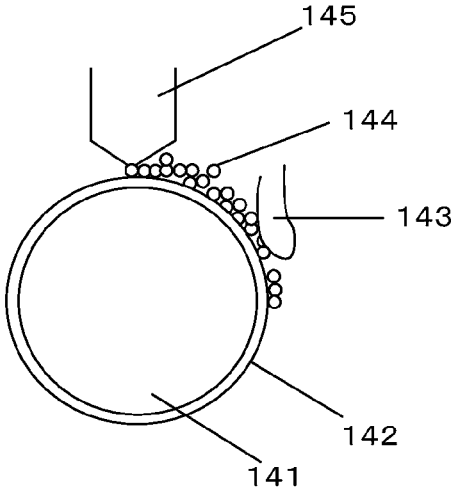
FIG. 4 is a diagram explaining a method of applying and forming a coating over a base member layer with a thermosetting liquid elastomer material.

After this, the rotation speed is increased to a predetermined speed. When the rotation speed reaches the desired predetermined speed, the mold is successively rotated with the speed kept constant. When the solvent is volatilized to some degree and the surface is leveled sufficiently, a powder supplying device 145 and a pressing member 143 are situated as shown in FIG. 4, and spherical particles (particles 144) from the powder supplying device 145 are sprinkled over the surface uniformly while the mold is rotated. The spherical particles sprinkled over the surface are pressed at a constant pressure by the pressing member 143. The particles are buried into the elastic layer by the pressing member 143, and excess particles are removed. Particularly because monodisperse spherical particles are used in the present invention, a surface structure based on uniform single particles can be formed with the simple process including only the leveling step by the pressing member. In FIG. 4, the reference numeral 141 denotes the mold, and the reference numeral 142 denotes the elastic layer.

It is possible to adjust the ratio by which the particles are buried in the elastic layer easily by, for example, increasing or decreasing the pressing force of the pressing member 143, although it may be possible to adjust the ratio by any other method.

After the particles are buried uniformly, the coating is cured by heating at a predetermined temperature for a predetermined time while the mold is rotated, to thereby form the elastic layer.

After sufficient cooling, the intended belt driving roller is obtained.

Figure 5:
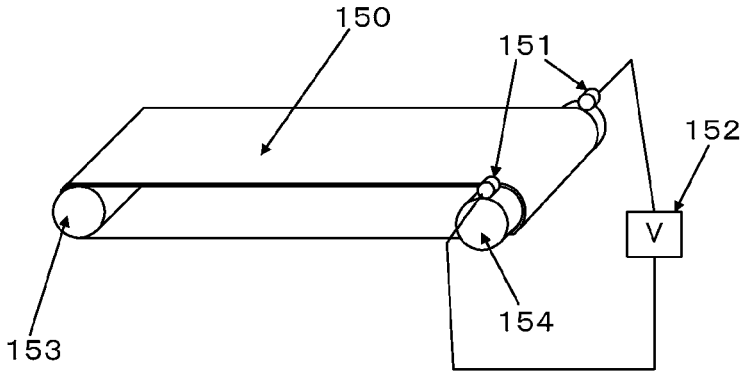
FIG. 5 is a diagram showing an example belt driving device using a member of the present invention.

FIG. 5 shows a schematic diagram of a belt driving device using the member.

A driving roller 154 is a driving roller as the electroviscous member of the present invention produced by the method described above. Electrode rollers 151 are placed in contact with the terminal electrode portions of this roller. The electrode rollers 151 are connected to a power supply 152. The roller 154 and a roller 153 need not have a tensile force by which a belt 150 is tensed stiffly, and it is only necessary that the rollers be located in a positional relationship that does not allow the belt 150 to sag unnecessarily. Even when the driving roller 154 is forced to rotate, the driving roller 154 runs idle and does not start the belt 150 to be driven. When the electric field is applied from the power supply 152 in this state, the driving roller 154 develops a viscosity force, and the belt 150 sticks to the driving roller 154, produces a torque, and rotates by following the rotation of the driving roller 154.

Owing to the driving based on this mechanism, no unnecessary load is imposed on the belt, and the belt can be ensured durability. Further, because the belt and the roller are adsorbed to each other, the belt will not shift in the axial direction, and the belt skew will not occur.

Next, an electrophotography apparatus equipped with the belt driving device of the present invention will be described.

Figure 7:
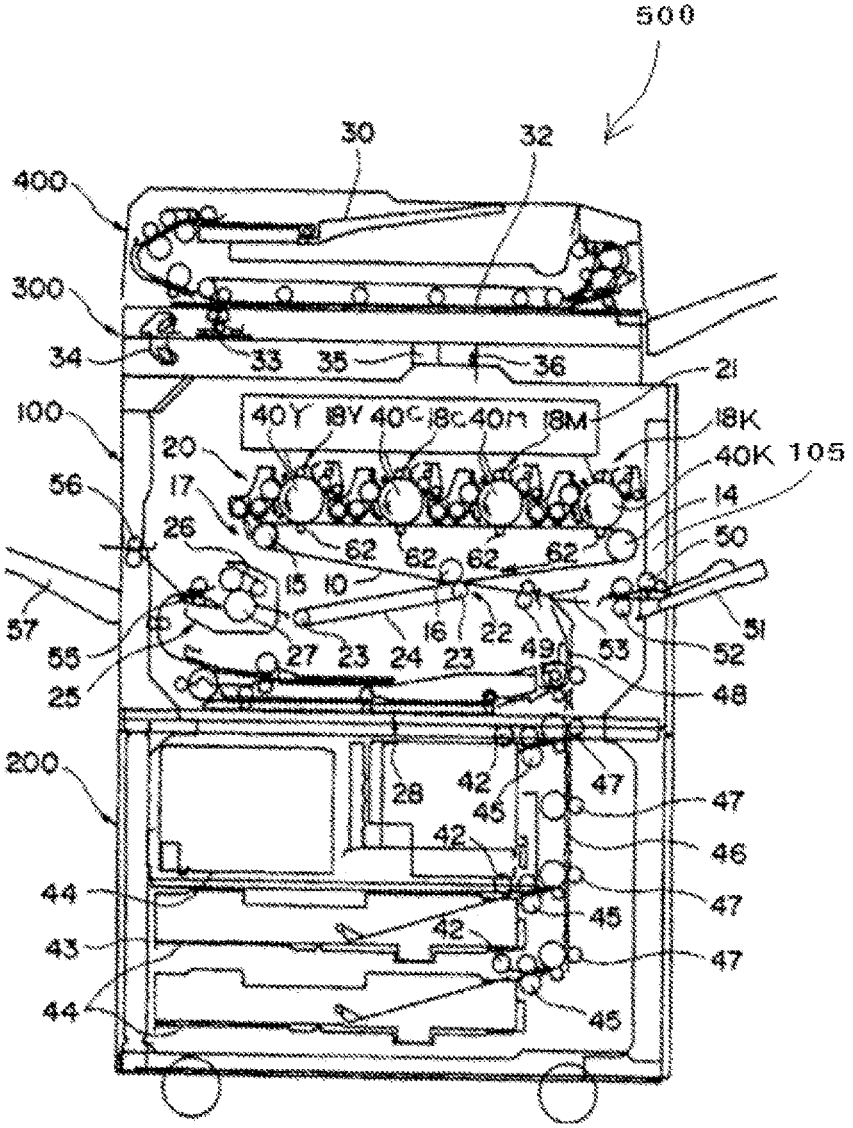
FIG. 7 is a diagram showing an example electrophotography apparatus of the present invention.

FIG. 7 shows an example of the electrophotography apparatus. In FIG. 7, the reference numerals denote the followings: 10 denotes an intermediate transfer belt, 14 denotes a driving roller (a first supporting roller), 15 denotes a driven roller (a second supporting roller), 16 denotes a second transfer unit facing roller (a third supporting roller), 17 denotes a belt cleaning device, 18Y, 18M, 18C, and 18K denote image forming units, 20 denotes a tandem image forming unit, 21 denotes an exposure device, 22 denotes a second transfer device, 23 denotes a supporting roller (a second transfer roller), 24 denotes a second transfer belt, 25 denotes a fixing device, 26 denotes a fixing belt, 27 denotes a pressurizing roller, 28 denotes a sheet overturning device, 30 denotes a script table, 32 denotes a contact glass, 33 denotes a first running member, 34 denotes a second running member, 35 denotes an imaging forming lens, 36 denotes an image reading sensor, 40Y, 40M, 40C, and 40K denote photoconductors, 42 denotes a paper feeding roller, 43 denotes a paper bank, 44 denotes a paper feeding cassette, 45 denotes a separating roller, 46 denotes a paper feeding path, 47 denotes a conveying roller, 48 denotes a paper feeding path, 49 denotes a registration roller, 50 denotes a paper feeding roller, 51 denotes a manual feed tray, 52 denotes a separating roller, 53 denotes a paper feeding path, 55 denotes a switching claw, 56 denotes an ejection roller, 57 denotes a paper ejection tray, 62 denotes a first transfer roller, 100 denotes a copier body, 105 denotes an intermediate transfer belt driving device, 200 denotes a paper feeding table, 300 denotes a scanner, 400 denotes an automatic paper conveyance device, and 500 denotes a copier.

As in this example, the electrophotography apparatus uses the belt members, namely the intermediate transfer belt 10, the second transfer belt 24, and the fixing belt 26, and is equipped with the intermediate transfer belt driving device 105, the second transfer device 22, and the fixing device 25 that are configured to drive the belts with a plurality of rollers 14 and 15, and 16 and 23 respectively.

These belt driving devices have a mechanism of driving and rotating the belts by means of rotation of the rollers due to a tensile force imposed between the rollers by a spring or the like. In this case, when a slip occurs between the roller and the internal surface of the belt, the belt cannot be driven. Hence, rollers made of a rubber having an adequate friction coefficient are used as the driving rollers. Further, according to this mechanism, the belt skew will occur during continuous driving. Hence, there is provided a meandering control mechanism configured to correct the direction of skew by swaying the driven roller 15.

In the present invention, rollers constituted by the electroviscous member are employed as the driving rollers used in these devices.

The electroviscous member may be employed as the driving rollers for driving any kinds of belt members other than those described above, such as a paper conveying belt and a photoconductor belt, although the apparatus of FIG. 7 is not equipped with such belts.

EXAMPLES

Next, specific Example will be described.

The present invention will be described below more specifically based on Example. However, the present invention is not limited by Example, but arbitrary modifications of Example are also included in the scope of the present invention as long as they do not depart from the spirit of the present invention.

Example 1

A polyimide film of which surface was plated with a copper foil was etched to thereby form a base member film over which a comb-teeth-shaped electrode composed of alternately arranged positive and negative electrodes as shown in FIG. 3 was formed. The obtained base member film was wound over the surface of a roller made of SUS and having an outer diameter of 40 mm and a width of 360 mm.

Next, the elastic layer was formed over the surface of the roller according to the following.

A method for forming the elastic layer will be described.

First, the materials shown below were blended and kneaded with a kneader, to thereby produce a rubber composition.

<Material Composition of Elastic Layer>

An acrylic rubber (NIPOL AR12 manufactured by Zeon Corporation): 100 parts by mass A stearic acid (beaded stearic acid TSUBAKI manufactured by NOF Corporation): 1 part by mass A cross-linking agent (DIAK. NO 1 (hexamethylenediamine carbamate) manufactured by Dupont Dow Elastomers Japan): 0.6 parts by mass A cross-linking promoter (VULCOFAC ACT55 (70% by mass of a salt of 1,8-diazabicyclo(5.4.0)undecene-7 and a dibasic acid and 30% by mass of amorphous silica) manufactured by Safic-Alcan): 0.6 parts by mass Next, a rubber solution having a solid content of 30% by mass was produced by dissolving the rubber composition obtained above in an organic solvent at the following blending ratio.

The rubber composition described above: 100 parts by mass

An ionic conductive agent (QAP-01 manufactured by Japan Carlit Co., Ltd.): 0.3 parts by mass A solvent (MAK manufactured by KH Neochem Co., Ltd.): 230 parts by mass While the roller around which the polyimide film over which the comb-teeth-shaped electrode was formed was wound was rotated, the produced rubber solution was applied spirally over the supporting member from a nozzle that jetted the rubber paint continuously and was moved in the axial direction of the supporting member. The amount of application was determined such that the final average film thickness would be 200 μm. After this, the base member over which the rubber paint was applied was set in a hot air circulating dryer while being rotated successively, and heated up to 100° C. at a temperature raising rate of 4° C./minute for 60 minutes.

After this, the heated product was taken out from the dryer and cooled, and silicone resin spherical particles (TOSPEARL 120 (a product with a volume average particle diameter of 2 μm); manufactured by Momentive Performance Materials Inc.) as spherical resin particles were sprinkled evenly over the surface of the product and fixed over the elastic layer with a polyurethane rubber blade pressing member pressed at a pressing force of 100 mN/cm according to the method of FIG. 4. After this, the product was again set in the hot air circulating dryer, and heated up to 170° C. at a temperature raising rate of 4° C./minute for 180 minutes, to thereby obtain a roller member.

The roller was used as the driving roller 14 for the intermediate transfer belt 10 of the electrophotography apparatus of FIG. 7, to thereby constitute a mechanism of applying an electric field to the driving roller 14 as shown in FIG. 5.

The spring for applying a tension to the intermediate transfer belt 10 was removed, and the operation of the meandering control mechanism by means of the driven roller 15 was turned off.

In this state, an attempt to rotate the driving roller 14 without applying a voltage from the power supply was made. As a result, the driving roller 14 did rotate, but the intermediate transfer belt 10 did not rotate.

Next, an attempt to rotate the driving roller 14 by applying a voltage of 1 kV from the power supply was made. As a result, the intermediate transfer belt 10 could be driven to rotate.

In this state, they were continuously rotated up to 1,000 rotations. As a result, they could be driven without the belt skew.

Comparative Example 1

The apparatus of FIG. 7 was driven in the normal way, except that the operation of the meandering control mechanism by means of the driven roller 15 for the intermediate transfer belt 10 of the apparatus was turned off. After about a hundred rotations, the intermediate transfer belt 10 skewed to one side, scraped against a metallic portion of a frame member of the intermediate transfer belt driving device 105 at the one side, and tore from the edge of the belt to about the center of the belt, which caused the apparatus to be forcibly stopped.

As can be understood from Example, use of the electroviscous member of the present invention as the driving roller of the belt driving device made it possible to drive and rotate the belt without imposing a load on the belt, and realized stable driving accompanied by no belt skew even without an additional mechanism for controlling meandering.

This application claims priority to Japanese application No. 2014-172427, filed on Aug. 27, 2014 and incorporated herein by reference.

What is claimed is:

1. A belt driving roller for a belt driving device configured to drive and rotate an endless belt with at least one driving roller of a plurality of rollers over which the belt is hung by its internal surface, the belt driving roller comprising:

an electroviscosity retaining member of which surface viscosity force reversibly changes under an effect of an electric field, wherein the electroviscosity retaining member comprises at least one layer over a conductive base member, and an outermost layer of the electroviscosity retaining member is an elastic layer holding particles at a surface thereof in a manner to partially expose the particles and having a surface layer structure composed of protruding regions formed of exposed portions of the particles and elastic body-exposed regions in which the particles having the exposed portions are absent.

2. The belt driving roller according to claim 1, wherein the conductive base member comprises a comb-teeth-shaped conductive region over an insulating base member, the comb-teeth-shaped conductive region being composed of conductive portions for positive bias application and conductive portions for negative bias application that are arranged alternately.

3. A belt driving device configured to drive and rotate an endless belt with at least one driving roller of a plurality of rollers over which the belt is hung by its internal surface, wherein the driving roller comprises an electroviscosity retaining member of which surface viscosity force reversibly changes under an effect of an electric field, and wherein the electroviscosity retaining member comprises at least one layer over a conductive base member, and an outermost layer of the electroviscosity retaining member is an elastic layer holding particles at a surface thereof in a manner to partially expose the particles and having a surface layer structure composed of protruding regions formed of exposed portions of the particles and elastic body-exposed regions in which the particles having the exposed portions are absent.

4. The belt driving device according to claim 3, wherein the belt is driven to rotate only when an electric field is applied to the driving roller, and is not driven to rotate when no electric field is applied to the driving roller.

5. The belt driving device according to claim 4, wherein the conductive base member comprises a comb-teeth-shaped conductive region over an insulating base member, the comb-teeth-shaped conductive region being composed of conductive portions for positive bias application and conductive portions for negative bias application that are arranged alternately.

6. The belt driving device according to claim 3, wherein the conductive base member comprises a comb-teeth-shaped conductive region over an insulating base member, the comb-teeth-shaped conductive region being composed of conductive portions for positive bias application and conductive portions for negative bias application that are arranged alternately.

7. An electrophotography apparatus, comprising: the belt driving device according to claim 4.

* * * * *